US005820470A

United States Patent [19]

Saunders

[11] Patent Number: 5,820,470

[45] Date of Patent: Oct. 13, 1998

[54] PORTABLE MODULAR PLAYING ARENA

[76] Inventor: Gregory Saunders, 28 Parker Ave., Sault Ste. Marie, Ontario, Canada, P6B 6A1

[21] Appl. No.: 888,400

[22] Filed: Jul. 7, 1997

[51] Int. Cl.[6] ..... A63C 19/00

[52] U.S. Cl. ..... 472/92; 472/90; 256/25

[58] Field of Search ..... 472/92, 94, 93; 52/126.5, 126.6, 263, 245; 256/24, 25, 31; 62/235

[56] References Cited

U.S. PATENT DOCUMENTS

| | | | |
|---|---|---|---|
| 2,257,219 | 9/1941 | Bath | 20/8 |
| 2,615,308 | 10/1952 | Thorns | 62/12 |
| 2,996,896 | 8/1961 | Johnson | 62/235 |
| 3,178,026 | 4/1965 | Christy | 52/126.5 |
| 3,379,031 | 4/1968 | Lewis, Jr. | 62/235 |
| 3,511,001 | 5/1970 | Morgan, Jr. | 52/126.5 |
| 3,991,530 | 11/1976 | Scourtes | 52/146 |
| 4,198,042 | 4/1980 | Olson | 472/92 |
| 4,815,301 | 3/1989 | Deloughery | 62/235 |
| 5,134,857 | 8/1992 | Burley | 62/235 |
| 5,622,021 | 4/1997 | Bookout | 472/92 X |

*Primary Examiner*—Kien T. Nguyen
*Attorney, Agent, or Firm*—Merek & Voorhees

[57] ABSTRACT

A portable modular outdoor playing arena having a plurality of modular floor panels and a plurality of generally vertically oriented modular side panels. The floor panels have a generally smooth flat upper surface and side surfaces that depend therefrom at approximate right angles. The floor panels are adjoined in a closed polygonal configuration to create a playing surface. The side panels surround and abut the floor panels and exert a compressive force on the floor panels to prevent lateral separation of adjacent floor panels. A seal forms a fluid tight connection between adjacent floor panels and at the juncture of the floor panels and the side panels. Each of the floor panels include adjustable legs to support the floor panels on the ground or on a sub-surface. The legs are vertically adjustable to allow for the levelling of the floor panels so that adjacent floor panels can be individually levelled and supported to provide a level playing surface.

11 Claims, 4 Drawing Sheets

PORTABLE MODULAR PLAYING ARENA

FIELD OF THE INVENTION

This invention relates to portable and modular playing arenas that can be readily assembled to provide a surface which can be flooded with water and frozen to present an ice skating rink or, which during times of warmer weather, can be used for purposes of playing basketball, ball hockey and for in-line skating. When desired the area can be disassembled and stored.

BACKGROUND OF THE INVENTION

Ice skating is an activity enjoyed by millions of adults and children around the world. People commonly practise this sport on a wide variety of different ice surfaces ranging from municipal areas, to frozen ponds and waterways, to home-made backyard ice rinks. The convenience and safety of having a backyard ice rink makes the idea attractive to both parents and children alike. Typically such rinks have been made by packing down snow in a defined area and flooding the packed snow with water until it freezes to create a frozen skating surface. To contain the water during brief periods of warmer temperatures, others have proposed devices that generally compromise a waterproof sheet or barrier that is laid on the ground and which may have a raised perimeter that contains the water preventing it from flowing away until temperatures are again sufficiently low to allow for freezing.

While the traditional methods of creating a backyard skating rink are somewhat effective, they suffer from a number of inherent deficiencies. First, the damage to the underlying grass and plant life can be significant on account of the formation of ice immediately over the ground surface. The use of plasticized or rubberized sheets to contain the water during times of warmer temperatures and also result in grass damage. In addition, since the ground or area over which the ice surface is to be created is normally not perfectly level, a sufficient depth of water needs to be used to ensure that there is an adequate depth of ice across the entire skating surface. For that reason lower areas will necessarily be flooded to a greater extent than higher areas, and thereby creating an uneven freezing and thawing continuum across the flooded surface.

Such prior methods of creating backyard skating surfaces are also extremely limited in terms of their seasonal use. That is, their use is limited to geographic areas having sufficiently cold temperatures to ensure adequate freezing. Even in colder temperature environments unexpected melting may occur during sunny days, even when the temperature is below the freezing point. The most common reasons for this is radiant heating by the sun and thermal heating of the ice surface from residual ground heat.

In the spring when the temperature rises above freezing such prior ice rinks melt and cease to provide any form of playing surface or arena of any sort.

SUMMARY OF THE INVENTION

The invention therefore provides a portable modular playing arena that addresses the deficiencies of prior used devices. The playing arena of the present invention is modular and portable in nature enabling it to be readily assembled and disassembled when desired. Furthermore, the invention is constructed to assist in maintaining a frozen skating surface during winter months, even during sunny days where radiant heating may take place. Finally, the invention also provides a modular playing arena that can equally be used during warmer weather for purposes of playing other sports or games aside from ice hockey or skating. For example, the invention may be used for purposes of in-line skating, for playing ball hockey, basketball, or in-door arena style soccer.

Accordingly, in one of its aspects the invention provides a portable modular outdoor playing arena that comprises a plurality of modular floor panels having a generally smooth flat upper surface and side surfaces that depend therefrom at approximate right angles, said floor panels adjoined in a closed polygonal configuration to create a playing surface; a plurality of generally vertically oriented modular side panels, said side panels arranged in a closed polygonal configuration surrounding and abutting said polygonal arrangement of said plurality of floor panels, said side panels exerting a compressive force on said floor panels to prevent lateral separation of adjacent floor panels; and, sealing means forming a fluid tight seal between adjacent floor panels and at the juncture of said floor panels and said side panels; where each of said modular floor panels including adjustable legs providing a means to support said floor panels on the ground or on a sub-surface, said legs being vertically adjustable to allow for the levelling of said floor panels such that adjacent floor panels can be individually levelled and supported to provide a level playing surface.

Further objects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

Figure 1:
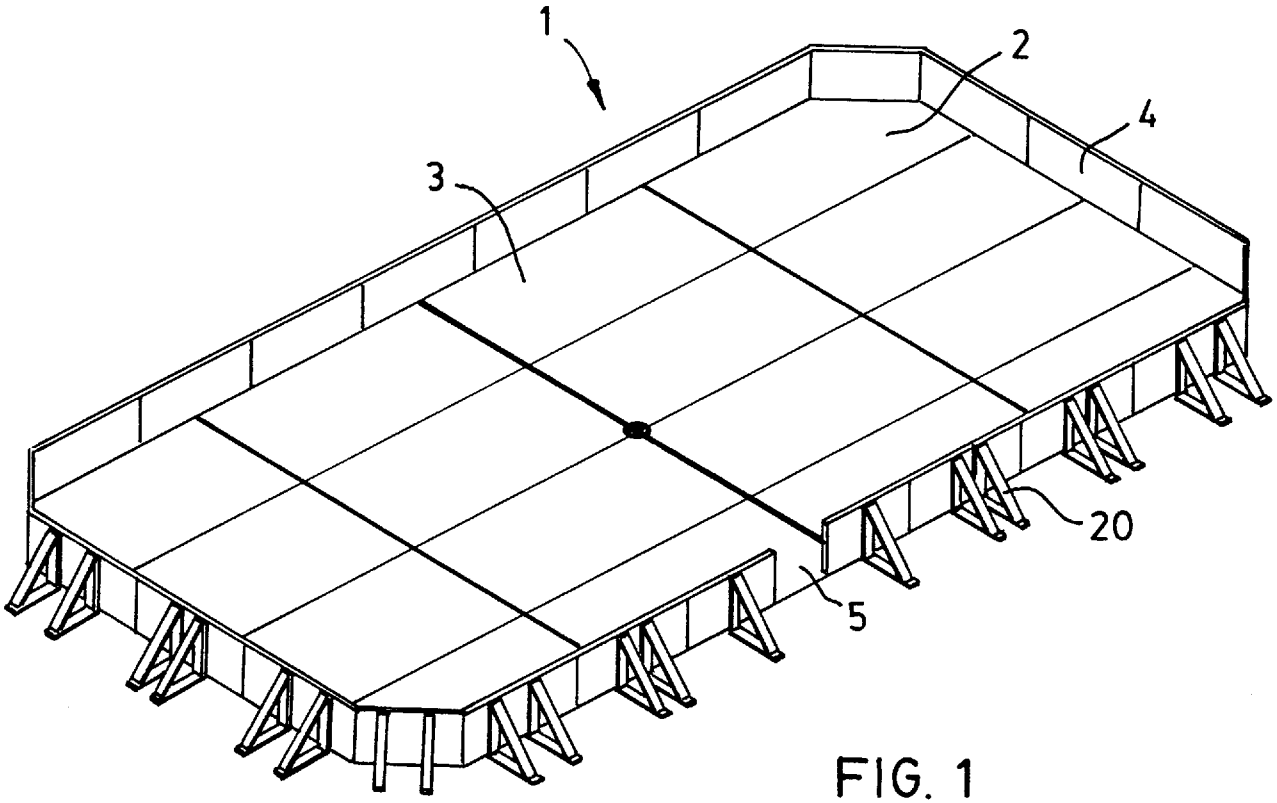
FIG. 1 is a plan perspective view of the portable modular playing arena of the present invention in its assembled form.
Figure 2:
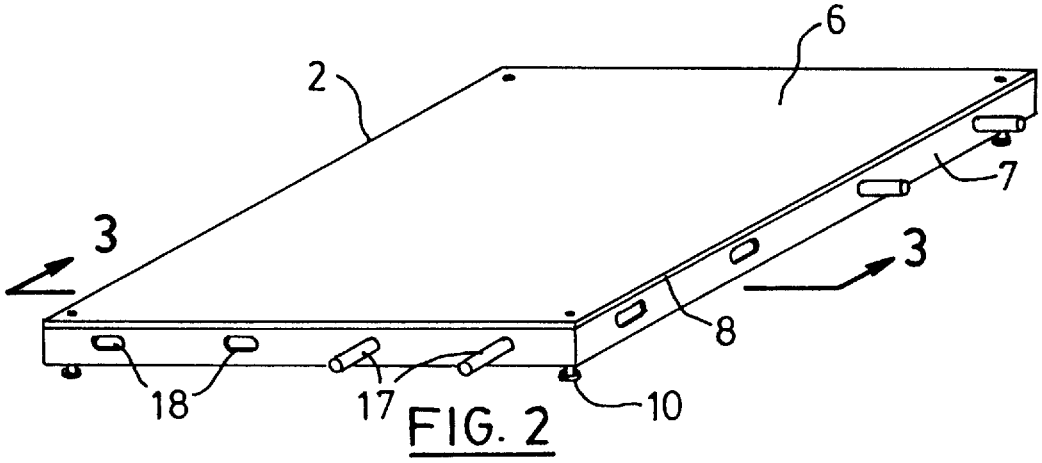
FIG. 2 is a plan perspective view of a modular floor panel pursuant to the present invention.
Figure 3:
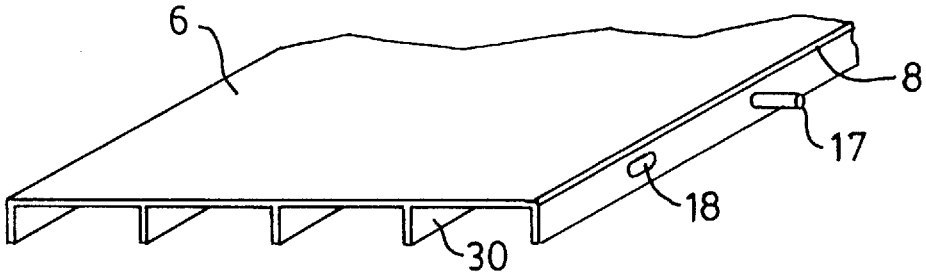
FIG. 3 is a sectional view taken along the line 3—3 of FIG. 2.

The present invention may be embodied in a number of different forms. This specification and the drawings that follow only describe and disclose some of the specific forms of the invention and are not intended to limit the scope of the invention as defined in the claims that follow herein.

Referring to FIGS. 1 through 4, the portable modular outdoor playing arena pursuant to the present invention is shown generally by the reference numeral 1. Arena I is comprised generally of a plurality of modular floor panels 2 that are arranged in a closed polygonal configuration creating a generally flat playing surface 3. Surrounding the floor panels 2 is a plurality of generally vertically oriented modular side panels 4 that are also arranged in a closed polygonal configuration about the sides of the polygonal arrangement of floor panels 2. Side panels 4 serve a dual purpose of providing a perimeter enclosure to the playing arena and also serve to exert a compressive force around the edges of the floor panels 2 in order to hold and maintain the floor panels in a tight configuration and thereby prevent lateral separation of adjacent floor panels. For convenience of entry onto playing surface 3, a doorway or entrance 5 may be provided at one or more locations along side panels 4.

The particular structure and configuration of floor panels 2 is shown more clearly in FIGS. 2 through 6. Floor panels 2 contain a generally smooth and flat upper surface 6 with side surfaces 7 that depend therefrom at approximately right angles. A sealing means 8 is provided to form a fluid-tight seal between adjacent floor panels such that water or fluid will be retained upon playing surface 3 when floor panels 2 are held in their polygonal configuration. In the preferred embodiment, sealing means 8 comprises a gasket or O'ring 9 positioned on side surfaces 7 of floor panels 2. However, it will be appreciated by those skilled in the art that a variety of other sealing mechanisms could equally be employed in order to create and maintain a fluid-tight seal between adjacent floor panels. For example, multiple gaskets or O'rings could be utilized in place of the single gasket shown in the drawings. Alternatively a sealing strip or tape could be placed upon the upper surfaces 6 of two abutting floor panels along their line of contact. It will be appreciated that in the same fashion that sealing means 8 provides a fluid-type seal between adjacent floor panels, sealing means 8 will also provide a fluid-type seal along the points of contact between floor panels 2 and side panels 4.

Each of the modular floor panels 2 also includes adjustable legs 10 that provide a means to support the floor panels on the ground or on a sub-surface over which the panels are positioned. Legs 10 are also vertically adjustable to allow for the levelling of floor panels 2 such that adjacent floor panels, when arranged in their closed polygonal configuration, can be individually levelled and supported to provide a smooth and level playing surface 3. In use, playing arena 1 will typically be assembled in the backyard of a home where the ground will not necessarily be perfectly flat or level. For that reason, since legs 10 are vertically adjustable they provide the user with the ability to quickly and easily position floor panel 2 upon the ground such that they are fully supported with their upper surfaces 6 being level.

Figure 4:
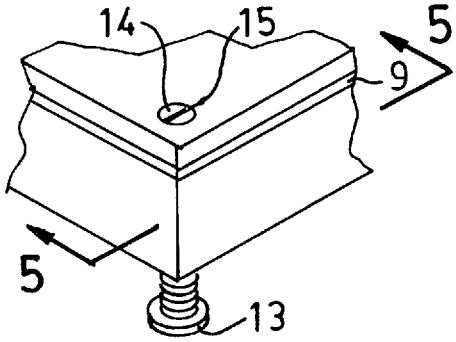
FIG. 4 is a detailed view of a corner of the modular floor panel of FIG. 2.
Figure 5:
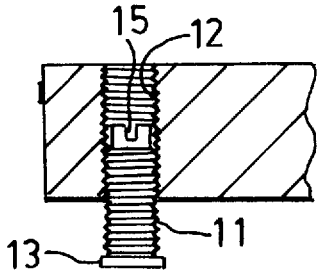
FIG. 5 is a sectional view taken along the line 5—5 of FIG. 4.

In the preferred embodiment, and as shown more particularly in FIGS. 4 and 5, legs 10 comprise posts 11 that are threadably received within bores 12 located near the corners of floor panels 2. Bores 12 extend perpendicularly through floor panels 2 such that threading posts 11 into or out of bores 12 will result in a vertical adjustment of the height of the floor panel. Preferably posts 12 have an enlarged bottom end 13 to more evenly distribute the weight of the floor panel over the ground. Posts 11 also preferably include a head portion 14 that contains a slot 15 to aid in threading it into or out of bore 12. Bores 12 extend completely through the upper surfaces 6 of floor panels 2 allowing for the entry of a screwdriver or other hand tool through the bores and into contact with slots 15, such that posts 11 can be rotated to either lift or lower the floor panels. This particular configuration has the advantage of providing an individual access to posts 11 from the upper surface 6 of floor panels 2 making it simpler to position and level the panels when they are initially assembled, and also permitting the simple re-adjustment of the height of the panels at a later point if necessary. For purposes of maintaining a fluid-tight seal on the upper surface 6, the threadable engagement of posts 11 with bores 12 is sufficiently tight to prevent the leakage of fluid therethrough.

Generally, floor panels 2 are constructed with a square upper surface 6. In this fashion a plurality of floor panels 2 can be arranged together to form a closed polygonal shape of a generally square or rectangular configuration. Commonly arenas that are used for purposes of skating and other sports are arranged in such configurations. The size of the rectangular configuration can be varied through using more or fewer floor panels.

Figure 6:
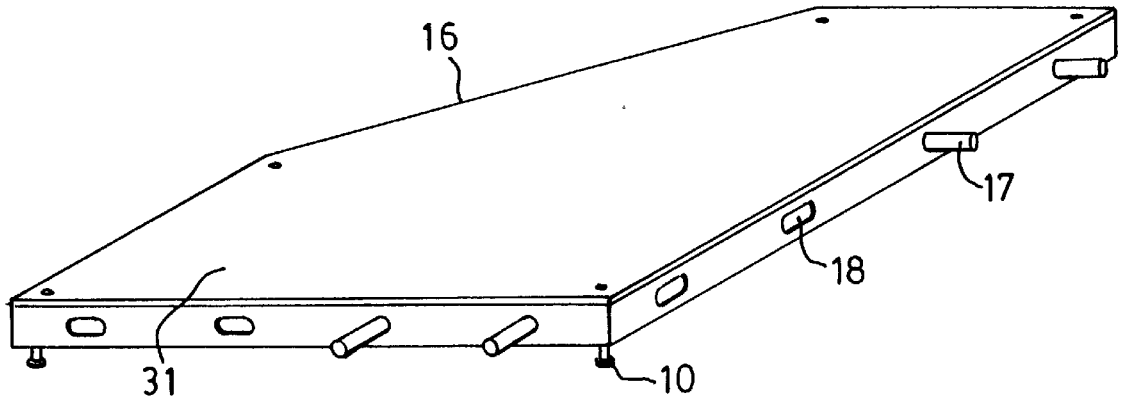
FIG. 6 is a plan perspective view of a modular corner floor panel pursuant to the present invention.

In order to avoid the creation of interior right angles in playing arena 1, a corner floor panel 31, having an angled side surface 16 as more clearly shown in FIG. 6, may be utilized. Through the provision of an angled side surface on 4 of the corner floor panels, the interior angle of the closed playing arena can be effectively "rounded-off" to form the interior surface as shown more clearly in FIG. 1. It should be understood that for purposes of simplicity of manufacturing the corner floor panel has a straight but angled side surface 16. However, side surface 16 could also be an arcuate surface thereby providing a smoother and more circular interior corner. For square or rectangular floor panels 2, a leg 10 is generally located at or near each corner. In the case of corner floor panel 31 a leg is also preferably positioned at each of the additional corners such that in the embodiment shown in FIG. 6, five legs are utilized.

To assist in the prevention of vertical displacement of adjacent floor panels when they are held together in their close polygonal configuration, floor panels 2 of the preferred embodiment also include a series of outwardly projecting pin members 17 and a series of slots 18 on their side surfaces 7. As shown more clearly in FIG. 2, pin members 17 extend outwardly from side surface 7 such that when two floor panels 2 are abutted together the pins 17 of one floor panel are receivable within the slots 18 of the adjacent panel. It will be appreciated that in this fashion the two panels will essentially become attached such that vertical displacement of one panel will result in vertical displacement of the other panel to the same degree. This structural feature not only helps to prevent shifting of the panels but also ensures that any heaving or settlement of individual panels will not result in the formation of a raised ridge along the line of intersection. In a similar fashion, pin members 17 on floor panels 2 are receivable within slots 19 on side panels 4 to prevent the vertical displacement of floor panels that are adjacent to the side panels when the floor panels and side panels are configured together to form playing arena 1.

In the preferred embodiment both floor panels 2 and side panels 4 are moulded or formed from a rubberized, plastic, fibreglass or other synthetic material. Formation of floor panels 2 and side panels 4 from such materials ensures that they have a high strength to weight ratio making them easier to transport, store and assemble. Such synthetic materials also are not subject to rotting, deterioration or the effects of harsh weather. Where floor panels 2 and side panels 4 are formed from a moulded material, pins 17 are preferably integrally moulded into the panel. Alternately, pins 17 could be fastened by a variety of known fastening means to the sides of the panels after their construction. In the later case, pins 17 could also be formed of a different material than that from which floor panels 2 or side panels 4 are manufactured. In addition, it will be appreciated that floor panels 2 and side panels 4 could also be constructed of wood, plasticized wood, or metal while remaining within the broad scope of the invention.

In order for side panels 4 to effectively exert a compressive force on floor panels 2 to hold them in a tight polygonal configuration, in the preferred embodiment side panels 4 include anchoring means 20 to secure side panels 4 to the ground or to a sub-surface. Referring to FIG. 1 and to FIGS. 7 through 10, anchoring means 20 preferably comprises a first brace 21 that extends outwardly and generally perpendicularly from the lower portion 22 of a side panel 4. A second brace 23 extends outwardly from the upper portion 24 of the side panel 4 and forms an acute angle therewith such that second brace 23 intersects first brace 21 at a distance away from side panel 4. It will be appreciated that while the embodiment in the drawings generally shows second brace 3 intersecting side panel 4 at an angle of approximately 45 degrees, a wide variety of other angles of intersection could equally be used while still providing an acceptable level of support to the side panel. An adjustable leg member 25 positioned in first brace 21 allows for the vertical alignment of the side panel through vertical adjustment of leg member 25. Leg member 25 is generally constructed in a similar fashion to legs 10 and threadably received within a bore extending through first brace 21. Accordingly, through vertical adjustment of leg member 25 side panel 4 can be adjusted so that it is placed in a vertical plane forming a right angle with adjacent floor panel 2.

Referring again to FIGS. 7 through 9, the connection of floor panels 2 to side panels 4 is shown in greater detail. Pin members 17 on floor panels 2 are received within slots 19 on side panels 4 to prevent vertical displacement of the floor panel with respect to the side panel. In addition, to help secure the floor panels to the side panels so that the two panels cannot be displaced horizontally, pins 17 are configured such that they sufficiently long to extend through side panels 4 so that a factor 26 can be secured to the end of the pins to prevent them from being removed from slots 19. Fastener 26 may take the form of any commonly available or used fasteners including a threaded nut, a compression or friction ring, or may comprise a simple hole through the end of pins 17 into which a bolt or cotter key may be inserted.

Figure 10:
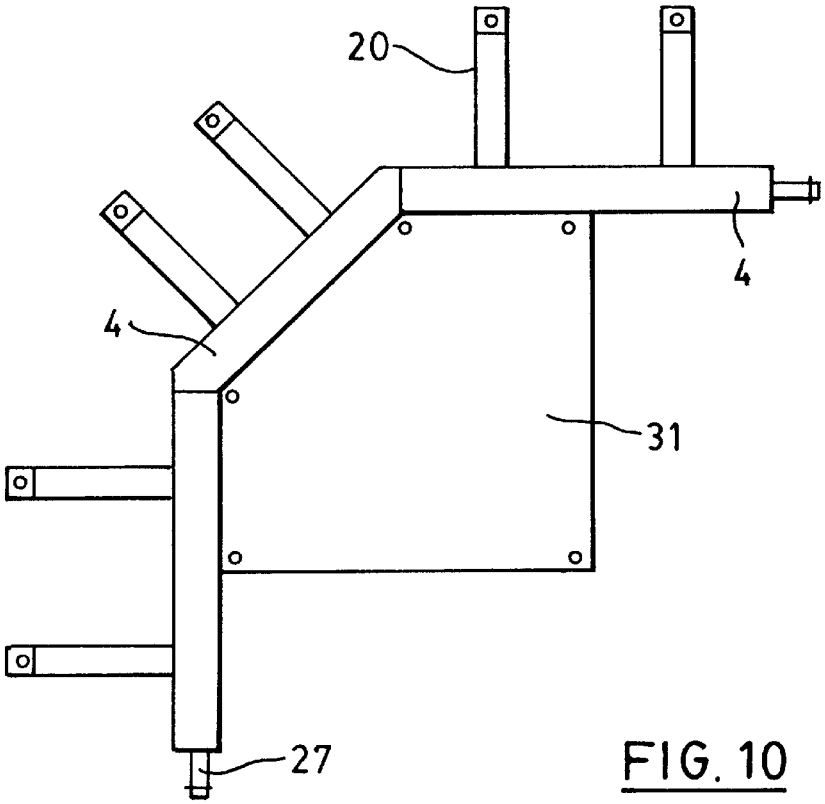
Figure 7:
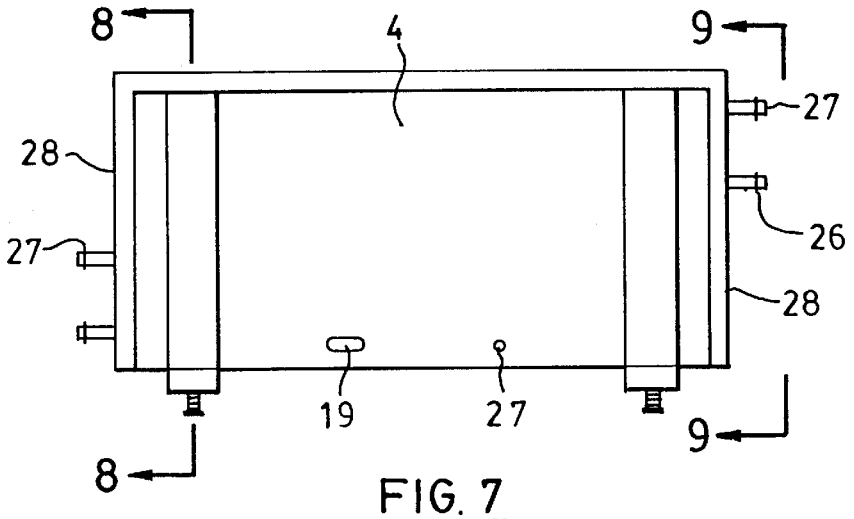
FIG. 7 is a rear lateral view of a side panel pursuant to the present invention.

In addition to the utilization of pin members 17 on floor panel 2, similarly constructed pin members 27 extend radially outward from the ends 28 of side panels 4. Ends 28 also contain slots 29 that are configured to accept and receive the pins 27 from a corresponding and adjacent side panel 4. In the preferred embodiment so that any two side panels may be placed adjacent to one another and connected together, two pin members 27 extend outward from the upper portion of one end 28 of side panel 4 and immediately below those pins there are situated two slots 29. On the opposite end of the same side panel the relative position of the pins and slots are reversed such that two pins 27 are positioned toward the bottom of the end with two slots 29 positioned toward the upper portion of the end. It will thus be apparent that in this manner when two side panels are placed adjacent to one another the lower pins of the fist panel will be received into the lower slots of the second panel while the upper pins of the second panel may be received into the upper slots of the first panel. When so connected, pins 27 are retained within slots 29 through the use of fastener 26 in a similar fashion as pins 17 from floor panels 2 are maintain within slots 19.

Where comer floor panels 31 are utilized, a slight modification to ends 28 of side panels 4 is made for those side panels that directly abut surface 16. As shown in FIG. 10, in this case ends 28 are angled slightly to allow them to align with the adjacent side panels.

To further increase the strength and durability of playing arena 1, floor panels 2 preferably include a series of strengthening ribs 30 positioned beneath upper surface 6. Ribs 30 provide rigidity to floor panels 2 and help prevent vertical flexure of the panels. In addition, side panels 4 are positioned about floor panels 2 such that the joints between adjacent side panels stager the joints between adjacent floor panels in order to more securely hold the floor panel system together and prevent separation. If desired, or deemed necessary for a particular application, stakes may be driven into the ground through an additional hole (not shown) through first brace 21 or it may be driven into the ground immediately behind the end of fist brace 21.

Figure 8:
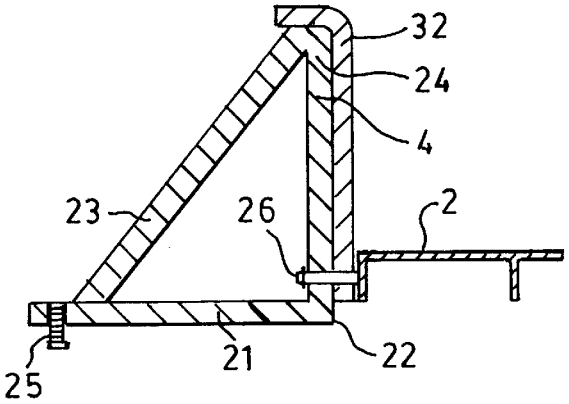
FIG. 8 is a sectional view taken along the line 8—8 of FIG. 7.
Figure 9:
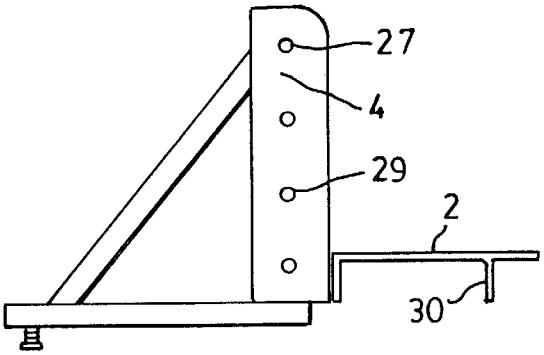
FIG. 9 is an end view from the direction 9—9 of the side panel shown in FIG. 7; and, FIG. 10 is a plan view of a series of side members and a modular corner floor panel as would be typically arranged at the corner of the portable modular playing arena pursuant to the present invention.

Additional durability may be incorporated into playing arena 1 through the use of a facing 32 on side panels 4. Facing 32 (as shown in FIG. 8) is preferably a high density synthetic product that presents a highly impact resistant surface on the interior of side panels 4. This surface is particularly useful when the arena is to be used for playing hockey as the side panels are likely to be subjected to impact from hockey pucks. Facing 32 preferably wraps around the top of side panels 4 to provide a smooth and rounded upper corner edge that will prevent injury if an individual falls or comes into contact with it.

It will be appreciated that through the described structure, the invention will provide a portable modular outdoor playing arena that can be readily assembled and disassembled when desired. During the winter months the arena can be easily assembled with its size depending upon the number of individual floor and side panels that are utilized. Increasing or decreasing the overall size of playing surface 3 merely requires adding or removing floor and side panels. Through the incorporation of legs 10, floor panels 2 can be easily levelled as they are assembled, or later levelled through accessing the legs from above playing surface 3. The combination of pin members 17 and slots 18 and 19 ensure that adjacent panels are not vertically displaced with respect to one another. Sealing means 8 provides a fluid tight seal between adjacent floor panels. Accordingly, during the winter months playing arena 1 may be assembled and flooded with a relatively thin layer of water that will freeze to create a skating rink. The rink may be used for pleasure skating or playing hockey. Since playing surface 3 will be substantially level, only a relatively small amount of water is necessary to completely flood the surface. This has the advantage of allowing for faster freezing and also providing an ice surface that is generally less susceptible to cracking and chipping.

In the preferred embodiment, floor panels 2 are white in colour as to reflect the sunlight and reduce the incidence of melting due to solar radiation. However, for proposes of making playing surface 3 resemble a hockey arena, red and blue lines may be painted or taped onto upper surface 6 of floor panels 2 prior to flooding and freezing. In the event of an unexpected warming trend causing the melting of the ice surface, the water on playing surface 3 is retained by means of sealing means 8 such that when temperatures once again drop below freezing the water re-freezes and creates a new ice surface.

During freezing of the water, side panels 4 assist in ensuring a smooth frozen surface by helping to act as a form of wind break to prevent rippling of the ice. In addition, since floor panels 2 are raised off of the ground by legs 10, cold air can circulate beneath the panels helping to prevent thawing of the ice and reduce heating by residual ground heat.

It will also be appreciated that as floor panels 2 are only in contact with the ground through legs 10, there will be less potential for damage to grass or plant life over which playing arena 1 is constructed. By elevating and levelling upper surface 6 there is less likelihood of saturating the ground with water after the ice surface melts and the water is drained, thereby reducing the potential for grass and plant life damage.

During summer months the arena 1 may be readily dismantled and stored for future use. The modular nature of floor panels 2 and side panels 4, and their particular unique method of assembly, makes playing arena 1 easy to disassemble and readily portable. However, if desired, playing arena 1 can be left in place during summer months to provide a playing surfloor hockey,vities such as in-line skating, basketball, floor hockey, indoor soccer, and the like. The smooth, level and sturdy upper surface of the floor panels, together with the strength and containment provided for by the side panels, will present a playing surface and arena suitable for a wide variety of activities.

It is to be understood that what has been described are the preferred embodiments of the invention and that it may be possible to make variations to these embodiments while staying within the broad scope of the invention. Some of these variations have been discussed while others will be readily apparent to those skilled in the art.

I claim:

1. A portable modular outdoor playing arena comprising:

(a) a plurality of modular floor panels having a generally smooth flat upper surface and side surfaces that depend therefrom at approximate right angles, said floor panels adjoined in a closed polygonal configuration to create a playing surface;

(b) a plurality of generally vertically oriented modular side panels, said side panels arranged in a closed polygonal configuration surrounding and abutting said polygonal arrangement of said plurality of floor panels, said side panels exerting a compressive force on said floor panels to prevent lateral separation of adjacent floor panels; and, (c) sealing means forming a fluid tight seal between adjacent floor panels and at the juncture of said floor panels and said side panels;

each of said modular floor panels including adjustable legs providing a means to support said floor panels on the ground or on a sub-surface, said legs being vertically adjustable to allow for the levelling of said floor panels such that adjacent floor panels can be individually levelled and supported to provide a level playing surface.

2. A device as claimed in claim 1 wherein said modular side panels include anchoring means to secure said side panels to the ground or to a sub-surface.

3. A device as claimed in claim 2 wherein said floor panels include a series of outwardly projecting pin members and a series of slots on each of their side surfaces, said pin members being receivable within said slots of adjacent floor panels to prevent vertical displacement of adjacent floor panels relative to each other when said floor panels are arranged in said polygonal configuration.

4. A device as claimed in claim 3 wherein said pin members on said side surfaces of said floor panels adjacent said side panels are received within slots in said side panels to prevent vertical displacement of said adjacent floor panels relative to said side panels.

5. A device as claimed in claim 4 wherein said adjustable legs comprise posts that are threadably received within bores extending perpendicularly through said floor panels, said floor panels being vertically adjustable through threading said posts into or out of said bores.

6. A device as claimed in claim 5 wherein said posts include head portions that are accessible from said upper surface of said floor panels such that the height of said floor panels can be adjusted from above said upper surface.

7. A device as claimed in claim 6 wherein said anchoring means comprises a first brace extending outwardly and generally perpendicularly from the lower portion of said side panels, and a second brace extending outwardly from the upper portion of said side panels, said second brace forming an acute angle with said side panels and intersecting said first brace.

8. A device as claimed in claim 7 wherein said first brace includes a vertically adjustable leg such that vertical adjustment of said leg allows for the vertical alignment of adjacent side panels.

9. A device as claimed in claim 8 wherein said sealing means comprises a gasket positioned on said side surfaces of said floor panels.

10. A device as claimed in claim 9 wherein said floor panels include strengthening ribs beneath said upper surfaces.

11. A device as claimed in claim 10 wherein said side panels include outwardly projecting pins that are received within holes in adjacent side panels when said side panels are arranged in said closed polygonal configuration, said pins when received within said holes preventing vertical and lateral displacement of said side panels relative to one another.

* * * * *